US009938975B2

(12) United States Patent
Cameron et al.

(10) Patent No.: US 9,938,975 B2
(45) Date of Patent: Apr. 10, 2018

(54) SCROLL COMPRESSOR INCLUDING SEAL WITH AXIAL LENGTH THAT IS GREATER THAN RADIAL WIDTH

(71) Applicant: Edwards Limited, Crawley, West Sussex (GB)

(72) Inventors: Alexander Murray Cameron, Polegate (GB); Peter David Jones, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 0 days.

(21) Appl. No.: 14/688,677

(22) Filed: Apr. 16, 2015

(65) Prior Publication Data

US 2015/0219101 A1 Aug. 6, 2015

Related U.S. Application Data

(63) Continuation of application No. 14/006,596, filed as application No. PCT/GB2012/050445 on Feb. 28, 2012, now abandoned.

(30) Foreign Application Priority Data

Mar. 29, 2011 (GB) ..... 1105297.4

(51) Int. Cl.
*F03C 2/00* (2006.01)
*F03C 4/00* (2006.01)
(Continued)

(52) U.S. Cl.
CPC ..... *F04C 27/005* (2013.01); *F04C 18/0215* (2013.01); *F04C 18/0223* (2013.01); *F04C 18/0284* (2013.01)

(58) Field of Classification Search
CPC ..... F04C 18/0215; F04C 18/0284; F04C 23/008; F04C 27/005; F01C 1/0215; F01C 19/08; F01C 19/10
(Continued)

(56) References Cited

U.S. PATENT DOCUMENTS 4,415,317 A 11/1983 Butterworth
4,437,820 A 3/1984 Terauchi et al.
(Continued)

FOREIGN PATENT DOCUMENTS

EP 0012614 A1 6/1980
EP 0041802 A1 5/1981
(Continued)

OTHER PUBLICATIONS

International Search Report and the Written Opinion of the International Searching Authority dated May 9, 2012 in counterpart International Application No. PCT/GB2012/050445, 10 pgs.
(Continued)

*Primary Examiner* — Theresa Trieu
(74) *Attorney, Agent, or Firm* — Shumaker & Sieffert, P.A.

(57) ABSTRACT

A scroll compressor 10 may include an orbiting scroll having an orbiting scroll wall extending axially from an orbiting scroll plate towards a fixed scroll; a fixed scroll having a fixed scroll wall extending axially from a fixed scroll plate towards the orbiting scroll; and an axially extending drive shaft having an eccentric shaft portion so that rotation of the eccentric shaft portion imparts an orbiting motion to the orbiting scroll relative to the fixed scroll. An axial end portion of the orbiting scroll wall has a first seal for sealing between the orbiting scroll wall and the fixed scroll plate, and an axial end portion of the fixed scroll wall has a second seal for sealing between the fixed scroll wall
(Continued)

and the orbiting scroll plate; and the first seal or the second seal has an aspect ratio of axial length to radial width which is 1.25:1 or greater.

17 Claims, 3 Drawing Sheets

(51) Int. Cl.
*F04C 2/00* (2006.01)
*F04C 27/00* (2006.01)
*F04C 18/02* (2006.01)

(58) Field of Classification Search
USPC ..... 418/55.1–55.6, 57, 142
See application file for complete search history.

(56) References Cited

U.S. PATENT DOCUMENTS

| | | | | |
|---|---|---|---|---|
| 4,561,832 | A | 12/1985 | Shimizu | |
| 4,627,799 | A | 12/1986 | Terauchi | |
| 4,730,375 | A | 3/1988 | Nakamura et al. | |
| 4,740,143 | A | 4/1988 | Nakamura et al. | |
| 4,753,583 | A | 6/1988 | Hiraga et al. | |
| 4,824,343 | A | 4/1989 | Nakamura et al. | |
| 4,869,658 | A | 9/1989 | Tsutsumi et al. | |
| 5,035,589 | A | 7/1991 | Fraser, Jr. et al. | |
| 5,222,882 | A | 6/1993 | McCullough | |
| 5,767,186 | A | 6/1998 | Shimokusuzono et al. | |
| 5,833,443 | A | 11/1998 | Lifson | |
| 6,142,755 | A | 11/2000 | Shiinoki et al. | |
| 6,193,487 | B1 | 2/2001 | Ni | |
| 6,354,825 | B1 | 3/2002 | Fujiwara et al. | |
| 6,720,071 | B2 | 4/2004 | Ishii | |
| 6,783,338 | B2 | 8/2004 | Moroi et al. | |
| 6,860,728 | B2 | 3/2005 | Takeuchi et al. | |
| 6,887,052 | B1 | 5/2005 | Bush et al. | |
| 7,293,969 | B2 * | 11/2007 | Midorikawa | F01C 19/08 418/142 |
| 7,364,418 | B2 | 4/2008 | Masuda et al. | |
| 7,950,912 | B2 | 5/2011 | Sato et al. | |
| 8,747,087 | B2 | 6/2014 | Collie et al. | |
| 2002/0057976 | A1 | 5/2002 | Kimura et al. | |
| 2003/0063989 | A1 | 4/2003 | Rinella | |
| 2012/0134862 | A1 | 5/2012 | Hockliffe et al. | |
| 2012/0141311 | A1 | 6/2012 | Hockliffe et al. | |
| 2014/0017109 | A1 | 1/2014 | Cameron et al. | |

FOREIGN PATENT DOCUMENTS

| | | | |
|---|---|---|---|
| EP | 0438025 | A3 | 7/1991 |
| EP | 0743454 | A2 | 11/1996 |
| EP | 1227245 | A2 | 7/2002 |
| EP | 1876356 | A1 | 1/2008 |
| EP | 2055955 | A1 | 6/2009 |
| GB | 2092675 | A | 8/1982 |
| JP | 55037515 | A | 3/1980 |
| JP | 1106989 | A | 10/1987 |
| JP | 02009975 | A | 6/1988 |
| JP | 02149785 | A | 11/1988 |
| JP | 6137285 | A | 5/1994 |
| JP | 07077181 | A | 3/1995 |
| JP | 07504250 | | 5/1995 |
| JP | H07-139485 | A | 5/1995 |
| JP | 07158568 | A | 6/1995 |
| JP | 08261171 | A | 8/1996 |
| JP | H09-158854 | A | 6/1997 |
| JP | 9195958 | A | 7/1997 |
| JP | H09256972 | A | 9/1997 |
| JP | 10047265 | A | 2/1998 |
| JP | 10141255 | | 5/1998 |
| JP | 11062858 | A | 3/1999 |
| JP | H11280676 | A | 10/1999 |
| JP | 2000-110747 | | 4/2000 |
| JP | 2000-329442 | | 11/2000 |
| JP | 2001003882 | A | 1/2001 |
| JP | 2005163745 | A | 12/2003 |
| JP | 2005351111 | A | 6/2004 |
| JP | 2006097656 | A | 9/2004 |
| JP | 2005-330850 | A | 2/2005 |
| JP | 2006077732 | A | 3/2006 |
| JP | 2006307760 | A | 11/2006 |
| JP | 2008184944 | A | 1/2007 |
| JP | 2007100516 | A | 4/2007 |
| WO | 9817895 | A1 | 4/1998 |
| WO | 0006906 | A1 | 2/2000 |
| WO | 0022302 | A | 4/2000 |

OTHER PUBLICATIONS

GB Search Report under Section 17(5) dated Jul. 27, 2011 in counterpart GB Application No. 1105297.4, 4 pgs.

Translation and original Notification of Reason for Rejection from counterpart Japanese Application No. 2014-501710, dated Dec. 24, 2015, 7 pp.

Office Action and translation thereof, from counterpart Taiwan Application No. 101109736, dated Apr. 14, 2016, 7 pp.

Communication pursuant to Article 94(3) EPC dated Aug. 30, 2016 in corresponding EP Application No. 12707129.8, 4 pgs.

The Notification of Reason for Rejection, and translation thereof, from counterpart Japanese Application No. 2014-501710, dated Nov. 14, 2016, 7 pp.

Office Action and translation thereof, from counterpart Japanese Application No. 2014-501710 dated Sep. 4, 2017, 9 pp.

Office Action and translation thereof, from counterpart Japanese Application No. 2014-501710 dated Dec. 25, 2017, 4 pp.

* cited by examiner

SCROLL COMPRESSOR INCLUDING SEAL WITH AXIAL LENGTH THAT IS GREATER THAN RADIAL WIDTH

CROSS REFERENCE TO RELATED APPLICATIONS

This application is a continuation of U.S. patent application Ser. No. 14/006,596, filed Sep. 20, 2013, which is a national stage entry under 35 U.S.C. § 371 of PCT Application No. PCT/GB2012/050445, filed Feb. 28, 2012, which claims the benefit of British Application No. 1105297.4, filed Mar. 29, 2011. The entire contents of U.S. patent application Ser. No. 14/006,596; PCT Application No. PCT/GB2012/050445; and British Patent Application No. 1105297.4 are incorporated herein by reference.

TECHNICAL FIELD

The present invention relates to a scroll compressor.

BACKGROUND

A prior art scroll compressor, or pump, 10 is shown in FIG. 7. The pump 10 comprises a pump housing 12 and a drive shaft 14 having an eccentric shaft portion 16. The shaft 14 is driven by a motor 18 and the eccentric shaft portion is connected to an orbiting scroll 20 so that during use rotation of the shaft imparts an orbiting motion to the orbiting scroll relative to a fixed scroll 22 for pumping fluid along a fluid flow path between a pump inlet 24 and pump outlet 26 of the compressor.

The fixed scroll 22 comprises a scroll wall 28 which extends perpendicularly to a generally circular base plate 30 and has an axial end face, or surface, 29. The orbiting scroll 20 comprises a scroll wall 34 which extends perpendicularly to a generally circular base plate 37 and has an axial end face, or surface, 35. The orbiting scroll wall 34 cooperates, or meshes, with the fixed scroll wall 28 during orbiting movement of the orbiting scroll. Relative orbital movement of the scrolls causes a volume of gas to be trapped between the scrolls and pumped from the inlet to the outlet.

A scroll pump may be a dry pump and not lubricated. In this case, in order to prevent back leakage, the space between the axial ends 29, 35 of a scroll wall of one scroll and the base plate 30, 37 of the other scroll is sealed by sealing arrangement, which generally comprise tip seals. The tip seals close the gap between scrolls caused by manufacturing and operating tolerances, and reduce the leakage to an acceptable level. However, tip seals suffer from the generation of tip seal dust and require a period of bedding in before achieving operational requirements. Further, in a normal scroll pump, tip seals require replacement at regular intervals after they become worn.

An enlarged cross-section through a portion of the fixed scroll 22 showing the tip seal 36 in more detail is shown in FIG. 6. The tip seal 36 has an aspect ratio of axial length to radial width which is 1:1. That is, the radial width of the tip seal is equal to the axial length of the tip seal so that as shown in cross-section in FIG. 6 the tip seal has a square cross-section. Accordingly, the tip seal is relatively stiff in a radial direction.

The tip seal is located in a channel 38 at the axial end of the fixed scroll wall. There is a small axial gap between an axial end of the tip seal 36 and the base of the channel 38 so that in use fluid occupying the gap forces the tip seal axially towards the base plate 37 of the orbiting scroll. Accordingly, the tip seal is supported on a cushion of fluid which serves to urge the seal towards an opposing seal surface. Additionally, and although not shown in FIG. 6, there is a radial clearance between the tip seal and the inner radial facing surfaces of the channel. During relative orbiting motion of the scrolls, the seal is urged against one inner radial surface for part of its motion and against the other inner radial surface for another part of its motion. As the seal moves between these positions, leakage is increased because there is a leakage path formed from one side of the seal to the other side of the seal. The tip seal 36 which is relatively stiff in the radial direction changes position in the channel relatively slowly thereby increasing leakage.

SUMMARY

The present invention seeks at least to mitigate one or more of the problems associated with the prior art.

The present invention provides a scroll compressor comprising: an orbiting scroll having an orbiting scroll wall extending axially from an orbiting scroll plate towards a fixed scroll; a fixed scroll having an fixed scroll wall extending axially from a fixed scroll plate towards the orbiting scroll; and an axially extending drive shaft having an eccentric shaft portion so that rotation of the eccentric shaft portion imparts an orbiting motion to the orbiting scroll relative to the fixed scroll; wherein an axial end portion of the orbiting scroll wall has a first seal for sealing between the orbiting scroll wall and the fixed scroll plate, and an axial end portion of the fixed scroll wall has a second seal for sealing between the fixed scroll wall and the orbiting scroll plate; and wherein the first seal or the second seal has an aspect ratio of axial length to radial width which is 1.25:1 or greater.

Other preferred and/or optional aspects of the invention are defined in the accompanying claims.

BRIEF DESCRIPTION OF THE DRAWINGS

In order that the present invention may be well understood, an embodiment thereof, which is given by way of example only, will now be described with reference to the accompanying drawings, in which.

DETAILED DESCRIPTION

Figure 1:
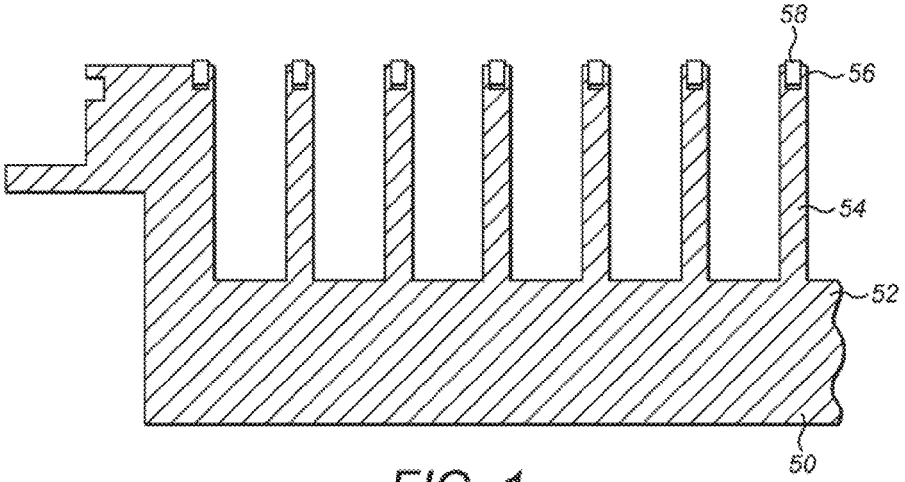
FIG. 1 shows a section through part of a fixed scroll of a scroll compressor.
Figure 7:
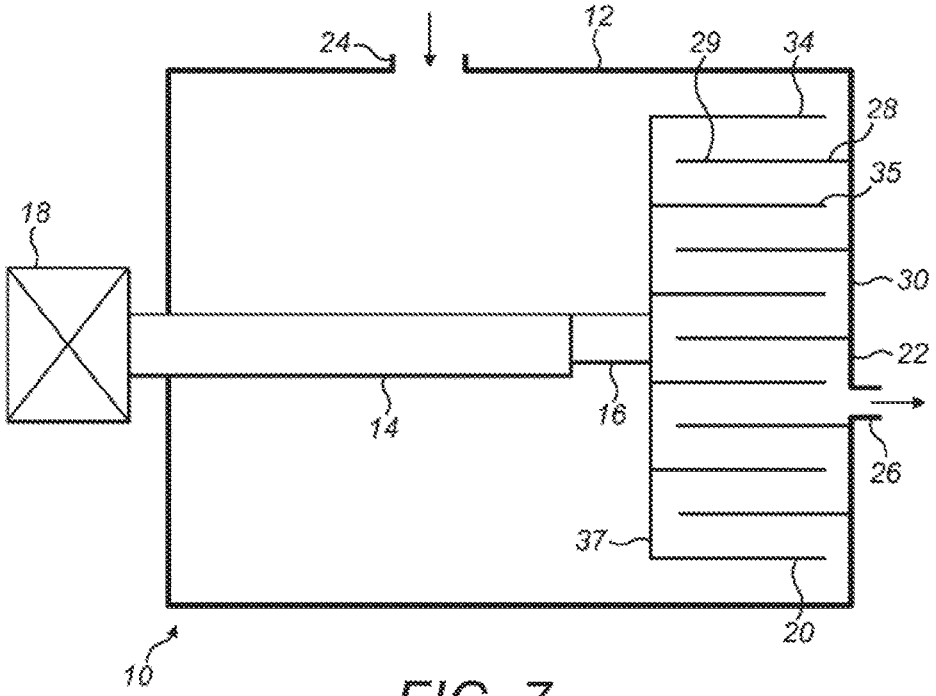
FIG. 7 Prior Art
FIG. 7 shows a schematic diagram of a prior art scroll compressor.

A section through part of a fixed scroll 50 is shown in FIG. 1. The fixed scroll 50 forms part of a scroll compressor embodying the invention which is similar in construction and operation to the prior art scroll compressor shown in FIG. 7, except for those aspects shown in FIGS. 1 to 5 and described below. For the sake of brevity therefore, the structure and operation of the whole scroll compressor will not be described again in detail.

The fixed scroll 50 shown in FIG. 1 comprises a fixed scroll plate 52 and a fixed scroll wall 54 extending generally perpendicularly therefrom typically in the form of an involute. Alternatively, in scroll pumps which are multi-start, the scroll wall may form an involute over only a portion of its length, usually its radially inner portion. The axial end of the fixed scroll wall comprises a channel 56 in which a tip seal 58 is located for sealing against an orbiting scroll 60 shown in FIGS. 2 and 3.

The description herein refers to the tip seal of the fixed scroll. It will be appreciated however that additionally or alternatively a similar tip seal arrangement may be provided for the orbiting scroll.

Figure 2:
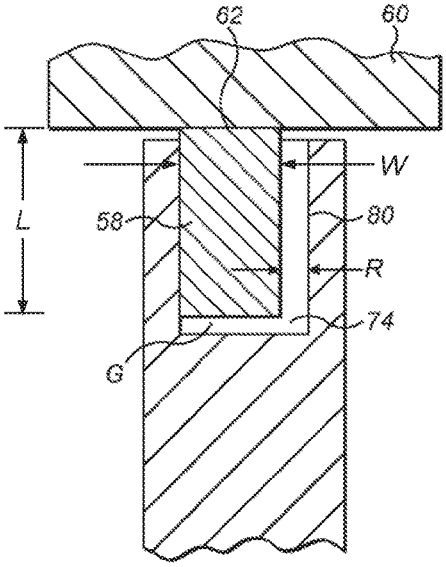
FIGS. 2 and 3 show enlarged views of a tip seal as shown in FIG. 1 in first and second locations in a channel.
Figure 3:
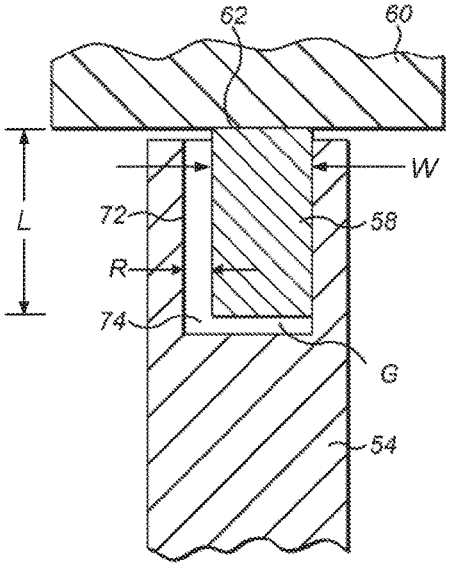
Figure 4:
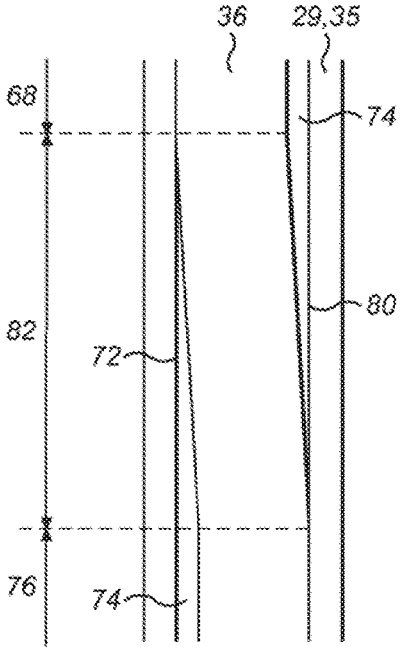
FIGS. 4 and 5 show a plan view of part of a prior art scroll wall and seal and a plan view of part of a scroll wall and seal according to an embodiment.
Figure 5:
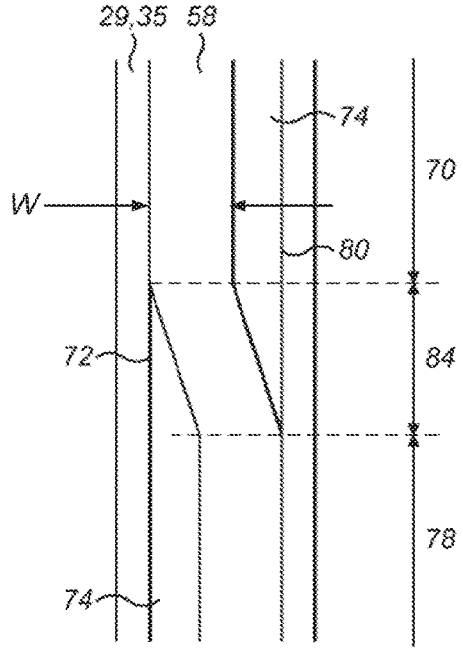

When the tip seal is installed, the tip seal 58 has an aspect ratio of axial length, L, to radial width, W, (as shown in FIGS. 2, 3, and 5) which is greater than 1.25:1. That is, where the ratio is x (axial length):y (radial width), and y equals 1, x is 1.25 or greater. As shown in FIGS. 1 to 3, the axial length is similar to the length shown in FIG. 4, however tip seal 58 is thinner in the radial direction and therefore lighter and more flexible. In the embodiment shown in FIGS. 2, 3, and 5, the ratio is 1.5:1 (axial length to radial width) and, depending on pumping requirements, the tip seal has an axial extent in the range from about 1.8 mm to about 4 mm and radial width in the range from about 1.2 mm to 2.6 mm. It will be seen therefore that the aspect ratio of axial length to radial width may be more than 2:1.

The arrangement shown offers a number of advantages over the prior art. When manufacturing the tip seal 58 from the materials used currently, the wear rate and tip-seal life (pressure-velocity regime) remains generally unchanged. Additionally, tip seal 58 shows shorter bedding-in or stabilization times. The tip seal 58 is thinner, and therefore more flexible, in the radial direction; in addition, its sectional area is smaller, making it also more flexible in the axial direction. Therefore it demonstrates better capability of presenting its full axial end face 62 against the orbiting scroll. Accordingly, most if not all of the axial face becomes bedded in quickly during initial use.

As the axial end face 62 occupies relatively less area than the axial end face of the prior art tip seal, less dust is generated due to abrasion against the orbiting scroll during use. As dust generated during use must be periodically removed, less dust generation decreases the cost of ownership. Further, in the prior art where the tip seal is relatively stiff in the radial direction, only a portion or corner of the axial end face may be presented to the orbiting scroll. It will be appreciated that whilst in the embodiment the axial end face is smaller than the axial end face in the prior art, a more flexible seal is better able to present its entire end face to the orbiting scroll whereas in the prior art only a corner of the scroll end face may be presented to the orbiting scroll.

FIGS. 4 and 5 show respectively a plan view of a portion of a tip seal in a groove of a scroll wall for a prior art arrangement and an arrangement in accordance with an embodiment of the invention. In both Figures, although the scroll wall is spiral, for the sake of explanation the scroll wall has been shown as linear.

In both FIGS. 4 and 5, during orbiting motion of a scroll wall 29, 35, crescent shaped pockets of fluid are trapped between the scroll walls 20, 22 and compressed as they are forced along flow paths towards the outlet of the pumping arrangement. As the trapped pockets of fluid pass along the paths, a tip seal 36, 58 experiences a changing direction of pressure difference across it. In this regard, the pressure difference across the seal tends to drive the seal radially inwards during a first part of orbiting motion and then radially outwards in a second part of orbiting motion, in a cyclic manner that repeats with every revolution of the shaft. A portion of a tip seal therefore is driven against a radially inner side of the groove when it is at an upstream portion of a trapped pocket and against a radially outer side of the groove when it is at a downstream portion of a trapped pocket. The reverse would be true of the tip seal of the opposing scroll.

In more detail, when considering the full length of the tip seals 36, 58 at any given time during use of the pump, first portions 68, 70 of the tip seals are located at the radially inner side 72 of the groove 74 and second portions 76, 78 of the tip seals are located at the radially outer side 80 of the groove. In between first and second portions, intermediate portions 82, 84 of the tip seals 36, 58 bridge the gap between the radially inner side 72 and the radially outer side 80 of the groove. Fluid can leak across the tip seals at the intermediate portions, since there is a leakage path which extends between the tip seals and the radially inner side 72 of the groove, underneath the tip seals and between the tip seals and the radially outer side 80 of the groove. That is, at the intermediate portions 82, 84 the tip seal does not block the seepage path by pressing against one of the sides of the groove. The prior art tip seal 36 has a larger radial width to axial depth and is therefore relatively stiff in the radial direction. Consequently, the length of the intermediate portions 82 are longer meaning that more leakage occurs. The tip seal 58 has a smaller radial width to axial depth (a greater axial depth to radial width ratio) and is therefore relatively flexible in the radial direction. Consequently, the length of the intermediate portions 84 are shorter meaning that less leakage occurs.

Figure 6:
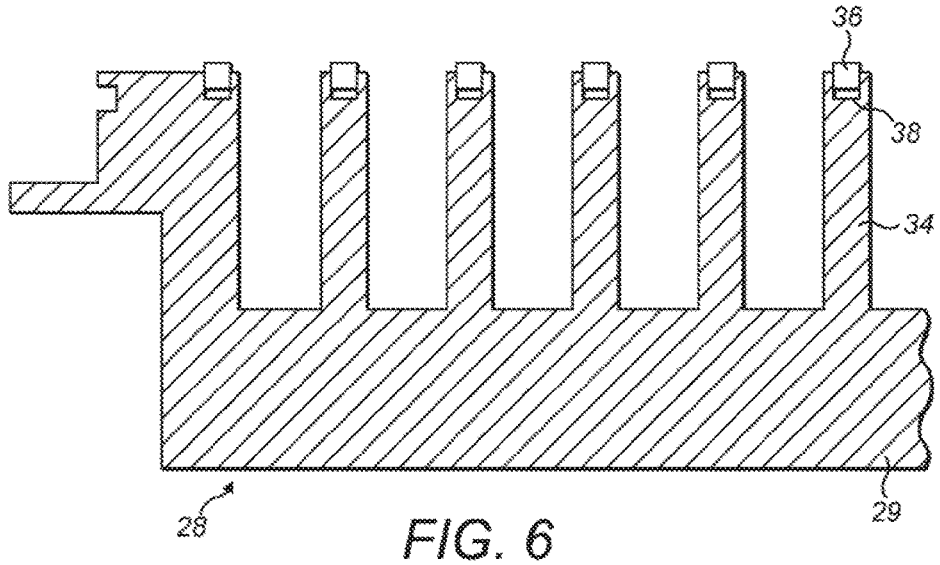
FIG. 6 Prior Art
FIG. 6 is a section through part of a fixed scroll of a prior art scroll compressor.

A further advantage of the present embodiment is that the space occupied by the tip seal is smaller in the radial direction and therefore scroll wall thickness is reduced. Accordingly, as shown in FIG. 1, six wraps are shown whereas in FIG. 6 only five wraps are shown. Therefore, for a pump of any given size, the present embodiment allows increased pumping capability because more wraps equates to a longer pumping path between inlet and exhaust, which increases compression. Alternatively the embodiment allows similar pumping capability in a smaller pump. In this latter regard, a pump which occupies less volume than the prior art is generally less expensive to manufacture as it requires less material and occupies a smaller foot-print when in use.

FIGS. 2 and 3 show the radial clearance R between a portion of tip seal 58 and the radial sides 72, 80 of the channel or groove 74. The clearance has been exaggerated in the Figures for the purposes of explanation. The tip-seal is pressure-loaded against the counter-face 62 of the orbiting scroll 60 by the gas that occupies the space G underneath the seal. The seal is urged against the sides of the channel by a combination of pressure differential in the radial direction and friction against the counter-face as the orbiting scroll orbits.

As described above, at different points along the length of a single tip-seal 58, the seal is located in the position shown in either FIG. 2 or 3, or is in the process of moving between the two shown positions. That is, the first portions 70 of the tip seal 58 are located at the radially inner side 72 of the channel in FIG. 2 and the second portions 78 of the tip seal are located at the radially outer side 80 of the channel in FIG. 3. When the tip seal is between the two shown positions a seepage path is formed across the tip seal causing leakage. The seepage path extends along one radial face of the tip seal, across gap G and along an opposing radial face of the tip seal. As tip seal 58 is more flexible in the radial direction than in the prior art, it moves between the two shown positions more quickly and therefore less leakage occurs.

As indicated above, one or both of the tip seals may have increased aspect ratio of more than 1.25:1 (axial length to radial width). Preferably, the aspect ratio is approximately the same along the full length of the each tip seals, however one or both of the tips seals may have different aspect ratios along their lengths. As such, in some examples, the first tip seal (the tip seal of the fixed scroll) may include a first aspect ratio of more than 1.25:1 and a second, different aspect ratio of more than 1.25:1, and the second tip seal (the tip seal of the orbiting scroll) may include a third aspect ratio of more than 1.25:1 and a fourth, different aspect ratio of more than 1.25:1. In some examples, each of the first aspect ratio, the second aspect ratio, the third aspect ratio, and the third ratio may be more than 1.5:1, or each may be more than 2:1.

Whilst a scroll compressor is typically operated for pumping fluid, instead it can operated as a generator for generating electrical energy when pressurized fluid is used to rotate the orbiting scroll relative to the fixed scroll. The present invention is intended to cover use of the scroll compressor for pumping and energy generation.

What is claimed is:

1. A pump including a scroll compressor comprising:

an orbiting scroll;

a fixed scroll having a fixed scroll wall extending in an axial direction from a fixed scroll plate towards the orbiting scroll, wherein the orbiting scroll has an orbiting scroll wall extending in the axial direction from an orbiting scroll plate towards the fixed scroll, wherein a radial direction is substantially orthogonal to the axial direction; and an axially extending drive shaft having an eccentric shaft portion so that rotation of the eccentric shaft portion imparts an orbiting motion to the orbiting scroll relative to the fixed scroll, wherein:

an axial end portion of the orbiting scroll wall has a first groove for receiving a first seal for sealing between the orbiting scroll wall and the fixed scroll plate, and an axial end portion of the fixed scroll wall has a second groove for receiving a second seal for sealing between the fixed scroll wall and the orbiting scroll plate;

the first seal or the second seal has an aspect ratio of an axial length to a radial width that is at least 1.25:1 or greater and the axial length ranges from 1.8 mm to 4 mm, and the radial width ranges from 1.2 mm to 2.6 mm; and the first seal or the second seal is received in the respective first groove or second groove with a radial clearance such that a first spiral portion of the first seal or the second seal is located at the radially inner side of the first groove or the second groove, a second spiral portion of the first seal or the second seal is located at the radially outer side of the first groove or the second groove, and in between the first spiral portion and the second spiral portion, an intermediate portion of the first seal or the second seal extends between the radially inner side and the radially outer side of the first groove or the second groove.

2. The scroll compressor of claim 1, wherein the first seal comprises the first and second spiral portions, wherein the second seal comprises a third spiral portion having a third aspect ratio of the axial length to the radial width and a fourth spiral portion having a fourth aspect ratio of the axial length to the radial width, and wherein both the third aspect ratio and the fourth aspect ratio are at least 1.25:1.

3. The scroll compressor of claim 2, wherein the axial end portion of the orbiting scroll wall has a channel for locating the first seal, and wherein the axial end portion of the fixed scroll wall has a channel for locating the second seal.

4. The scroll compressor of claim 2, wherein at least one of the third aspect ratio or the fourth aspect ratio is at least 1.5:1 or greater.

5. The scroll compressor of claim 4, wherein at least one of the third aspect ratio or the fourth aspect ratio is at least 2:1 or greater.

6. The scroll compressor of claim 1, wherein the axial end portion of the orbiting scroll wall has a channel for locating the first seal, and wherein the axial end portion of the fixed scroll wall has a channel for locating the second seal.

7. The scroll compressor of claim 1, wherein the first aspect ratio and the second aspect ratio are different.

8. A seal for a pump including a scroll compressor comprising an orbiting scroll; a fixed scroll having a fixed scroll wall extending in an axial direction from a fixed scroll plate towards the orbiting scroll, wherein the orbiting scroll has an orbiting scroll wall extending in the axial direction from an orbiting scroll plate towards the fixed scroll, wherein a radial direction is substantially orthogonal to the axial direction, and wherein the orbiting scroll wall defines a groove; and an axially extending drive shaft having an eccentric shaft portion so that rotation of the eccentric shaft portion imparts an orbiting motion to the orbiting scroll relative to the fixed scroll, wherein the seal comprises:

a first portion having a first aspect ratio of an axial length to a radial width and a second portion having a second aspect ratio of the axial length to the radial width, wherein both the first aspect ratio and the second aspect ratio are at least 1.25:1 or greater and the axial length ranges from 1.8 mm to 4 mm, and the radial width ranges from 1.2 mm to 2.6 mm, wherein the seal is configured to extend between the orbiting scroll wall and the fixed scroll plate and form a seal there between, and wherein the radial width of the seal is sized to be received in the groove with a radial clearance such that a first spiral portion of the seal is located at the radially inner side of the groove, a second spiral portion of the seal is located at the radially outer side of the groove, and in between the first spiral portion and the second spiral portion, an intermediate portion of the seal extends between the radially inner side and the radially outer side of the groove.

9. The seal of claim 8, wherein at least one of the first aspect ratio or the second aspect ratio is 1.5:1 or greater.

10. The seal of claim 9, wherein at least one of the first aspect ratio or the second aspect ratio is at least 2:1 or greater.

11. The seal of claim 8, wherein the seal is configured to be located in the groove of an axial end portion of the orbiting scroll wall.

12. The seal of claim 8, wherein the first aspect ratio and the second aspect ratio are different.

13. A seal for a pump including a scroll compressor comprising an orbiting scroll; a fixed scroll having a fixed scroll wall extending in an axial direction from a fixed scroll plate towards the orbiting scroll, wherein the fixed scroll wall defines a groove, wherein the orbiting scroll has an orbiting scroll wall extending in an axial direction from an orbiting scroll plate towards the fixed scroll, wherein a radial direction is substantially orthogonal to the axial direction; and an axially extending drive shaft having an eccentric shaft portion so that rotation of the eccentric shaft portion imparts an orbiting motion to the orbiting scroll relative to the fixed scroll, wherein the seal comprises:

a first portion having a first aspect ratio of an axial length to a radial width and a second portion having a second aspect ratio of the axial length to the radial width, wherein both the first aspect ratio and the second aspect ratio are at least 1.25:1 or greater and the axial length ranges from 1.8 mm to 4 mm, and the radial width ranges from 1.2 mm to 2.6 mm, wherein the seal is configured to extend between the fixed scroll wall and the orbiting scroll plate and form a seal there between, and wherein the radial width of the seal is sized to be received in the groove with a radial clearance such that a first spiral portion of the seal is located at the radially inner side of the groove, a second spiral portion of the seal is located at the radially outer side of the groove, and in between the first spiral portion and the second spiral portion, an intermediate portion of the seal extends between the radially inner side and the radially outer side of the groove.

14. The seal of claim 13, wherein at least one of the first aspect ratio or the second aspect ratio is 1.5:1 or greater.

15. The seal of claim 14, wherein at least one of the first aspect ratio or the second aspect ratio is at least 2:1 or greater.

16. The scroll compressor of claim 13, wherein the seal is configured to be located in the groove of an axial end portion of the fixed scroll wall.

17. The seal of claim 13, wherein the first aspect ratio and the second aspect ratio are different.

* * * * *